US007055706B2

(12) United States Patent
Kurs

(10) Patent No.: US 7,055,706 B2
(45) Date of Patent: Jun. 6, 2006

(54) DRINK BOTTLE

(75) Inventor: Ingo Kurs, Berlin (DE)

(73) Assignee: Eisvogel Nutzeis GmbH, Berlin (DE)

( * ) Notice: Subject to any disclaimer, the term of this patent is extended or adjusted under 35 U.S.C. 154(b) by 396 days.

(21) Appl. No.: 10/475,629

(22) PCT Filed: Apr. 11, 2002

(86) PCT No.: PCT/DE02/01429

§ 371 (c)(1),
(2), (4) Date: Oct. 20, 2003

(87) PCT Pub. No.: WO02/085714

PCT Pub. Date: Oct. 31, 2002

(65) Prior Publication Data

US 2004/0112904 A1 Jun. 17, 2004

(30) Foreign Application Priority Data

Apr. 20, 2001 (DE) ..... 201 07 295 U
Apr. 9, 2002 (DE) ..... 102 16 297

(51) Int. Cl.
*B65D 1/04* (2006.01)

(52) U.S. Cl. ..... 215/6; 215/387; 215/14; 215/27; 215/205; 215/211; 215/213; 215/216; 215/365; 215/382; 215/383; 215/384; 215/385; 220/600; 62/293; 62/372; 62/457.4

(58) Field of Classification Search ..... 215/387, 215/14, 27, 205, 211, 213, 216, 36, 5, 228, 215/6, 366, 379, 382, 383, 384, 385, 12, 215/1, 388; 220/676, 678, 662; 426/109; 62/293, 457.4, 372
See application file for complete search history.

(56) References Cited

U.S. PATENT DOCUMENTS

| | | | | |
|---|---|---|---|---|
| 2,075,137 | A * | 3/1937 | Rosen | 62/386 |
| 2,374,092 | A * | 4/1945 | Glaser | 215/6 |
| 2,490,379 | A * | 12/1949 | Schlumbohm | 62/281 |
| 4,485,636 | A * | 12/1984 | Hilado | 62/430 |
| 4,886,176 | A * | 12/1989 | Steakley | 215/229 |
| 5,090,213 | A * | 2/1992 | Glassman | 62/457.3 |
| 6,112,537 | A * | 9/2000 | Broadbent | 62/293 |
| 6,276,163 | B1 * | 8/2001 | Broadbent | 62/457.4 |
| 6,598,418 | B1 * | 7/2003 | Holley, Jr. | 62/457.3 |

FOREIGN PATENT DOCUMENTS

| | | |
|---|---|---|
| DE | G1 973 783 | 11/1967 |
| DE | 69 45265 | 9/1969 |
| DE | G85 26 612 | 12/1985 |
| DE | 36 36 538 | 4/1987 |
| DE | 199 09 972 | 6/1997 |
| DE | 199 14 753 | 8/2000 |
| DE | 19914753 A1 * | 8/2000 |

* cited by examiner

*Primary Examiner*—Jes F. Pascua
*Assistant Examiner*—Shawn M. Braden
(74) *Attorney, Agent, or Firm*—Andrew Wilford

(57) ABSTRACT

A drink bottle has a side wall and a floor together forming an interior drink space, an array of tubes extending away from the floor, defining an downwardly open compartment and a plurality of windows, having upper ends in fluid communication with the drink space at the floor, and having lower ends remote from the floor. A hollow base ring spaced from the floor is attached to the lower ends and in fluid communication through the tubes with the drink space. A container adapted to hold ice is fitted inside the compartment and removable from the compartment through the base ring. This container is visible from outside through the windows.

7 Claims, 2 Drawing Sheets

DRINK BOTTLE

CROSS REFERENCE TO RELATED APPLICATIONS

This application is the US national phase of PCT application PCT/DE02/01429, filed 11 Apr. 2002, published 31 Oct. 2002 as WO 02/085714, and claiming the priority of German patent application 20107295.5 itself filed 20 Apr. 2001 and German patent application 10216297.2 itself filed 9 Apr. 2002.

FIELD OF THE INVENTION

The invention relates to a bottle, in particular a drink bottle, with a body for holding a drink, for example water, seltzer, cola, juice, or the like and a smaller container that completes the shape of the body and that holds a cooling substance such as ice, the body being formed of one piece as a wall and floor and forming an externally accessible compartment for the container or the like.

BACKGROUND OF THE INVENTION

German 85 26 612.4 filed 19 Sep. 1985 by O. Nefzger describes a cooling or warming device for small containers like bottles or glasses. The container has an external screwthread at its lower end. A smaller container is attached to and forms a continuous continuation of the larger container. This smaller container has an upper edge with an internal screwthread. The large container is screwed to the smaller container. The smaller container is filled with ice to cool the drink. This known state of the art is particularly usable with glass containers such as champagne bottles, champagne and beer glasses in which the cooling system is directly incorporated.

The disadvantage of this known teaching is that in order to hold the cooling medium it is necessary to provide a wholly separate glass container that must be mounted on the bottle. Use is difficult and direct cooling of the drink, as particular desired with juice, lemonade, or cola drinks, is not possible.

German 196 09 972 filed 8 Dec. 1995 by L. Bonczek describes a system for packaging and/or storing products, in particular food, in a container that has a compartment with an opening through which the product can be loaded in and that has another compartment for holding a second product. This second comportment is partitioned off from the product holding the first product and the opening is closable. The second compartment in this package covered up by closing the opening and does not serve to cool the package-contents or to hold an ice-filled drinking glass.

Standard commercial bottles, for example soda bottles, have no system for cooling the drink. Since these bottles, in particular the 1- and 2-liter bottles, are very bulky, they are always cooled in large ice chests or refrigerators. The bottles warm up when taken out of the cooler relatively quickly, which is not wanted.

It is further known to provide liquid containers with a cup fitting over the bottle and serving for drinking or for pouring (German 199 14 753 filed 31 Mar. 1999 by L. Papeo).

A cooling drinking glass is also known that has an ice compartment molded right into the glass or plastic and that serves to hold ice. In another known cooling derive (see German 69 45 265 filed 9 Sep. 1969) the drinking vessel has an integral or added-on compartment into which an appropriate coolant is loaded. All these known solutions have the disadvantage that the coolant or the drink vessel is completely surrounded by the body of the bottle and is not visible from outside. It is impossible to determine if the ice serving for cooling is still there after some time out of the refrigerator and thus is no longer effective. This it particularly disadvantageous with larger drink bottles as for example 1- and 2-liter drink bottles.

OBJECT OF THE INVENTION

Starting from this state of the art, it is the object of the invention to so improve a drink bottle of the above-described type that while retaining a simple, easy, and user-friendly usability one gets an effective and long-lasting cooling of the bottle while still being able to drink directly from it.

SUMMARY OF THE INVENTION

This object is achieved according to the invention in that at least one tube is formed in the bottle wall defining the outer compartment and is in fluid communication with a drink-filled space and the floor, the tube holding the container in the compartment and the compartment being visible from outside through the bottle wall and the tubes.

The drink bottle according to the invention is above all characterized by an effective cooling of the drink contents by means of the larger drink contact area. This is achieved in that the outer compartment of the drink bottle holds a drinking glass that can be filled with ice as a coolant and that is externally visible so that as soon as the cooling effect is lost, ice cubes can be reloaded.

By stripping off the tear-off strip on the lower base ring it is easy to take the drinking glass out of the compartment. The ice-filled drinking glass is visible from outside through the bottle wall so that it is possible to provide it with advertising, for example as colored ice cubes.

In addition the drink bottle according to the invention has the advantage that even though it accommodates a drinking glass inside itself, it can be filled normally. The drinking glass can be printed so that it can meet any design or shape criterion.

BRIEF DESCRIPTION OF THE DRAWING

An embodiment of the invention is described more closely in the following with reference to a drawing. Therein.

SPECIFIC DESCRIPTION

Figure 1:
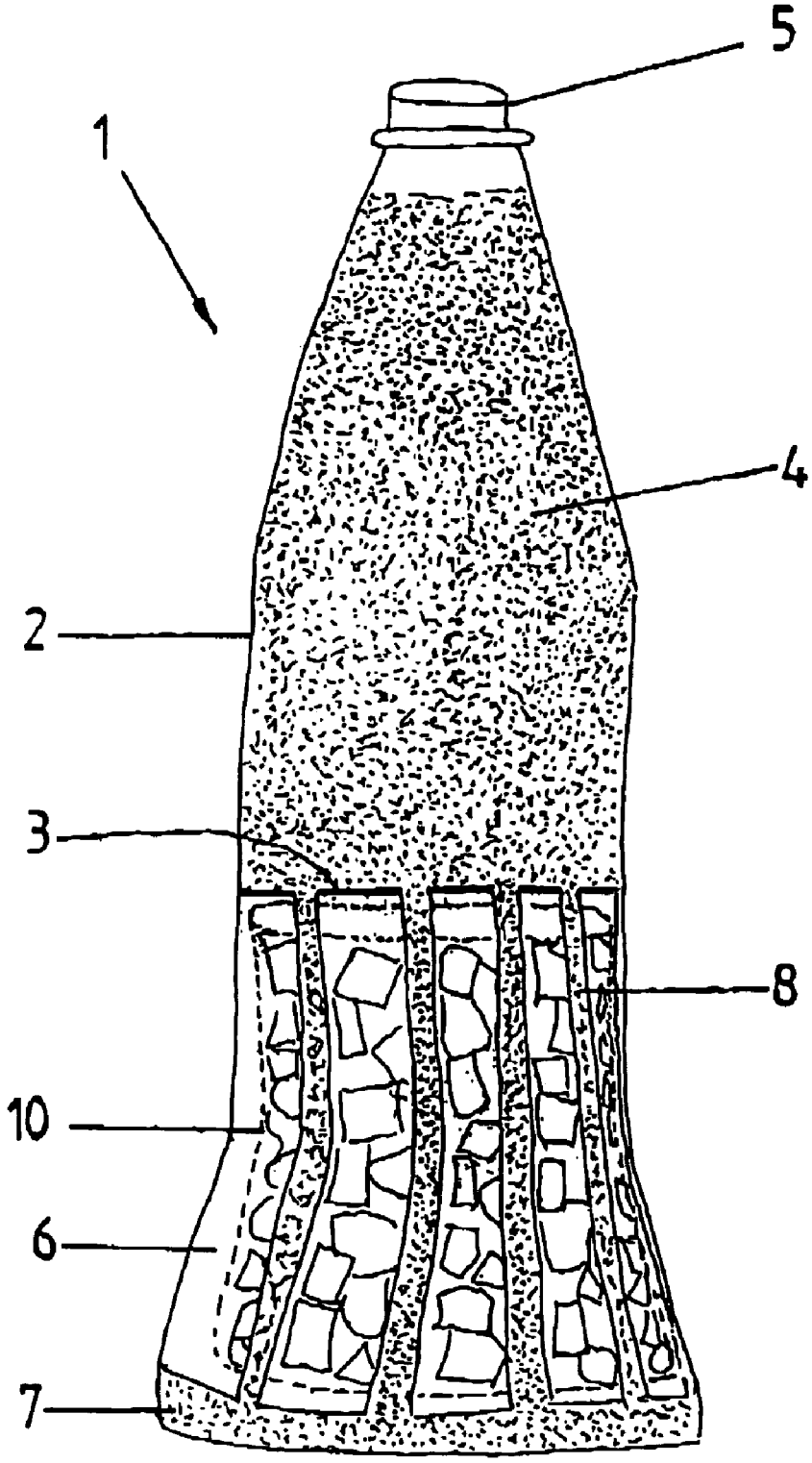
FIG. 1 is a side view of the drink bottle according to the invention with a drinking glass set in a separate compartment.
Figure 2:
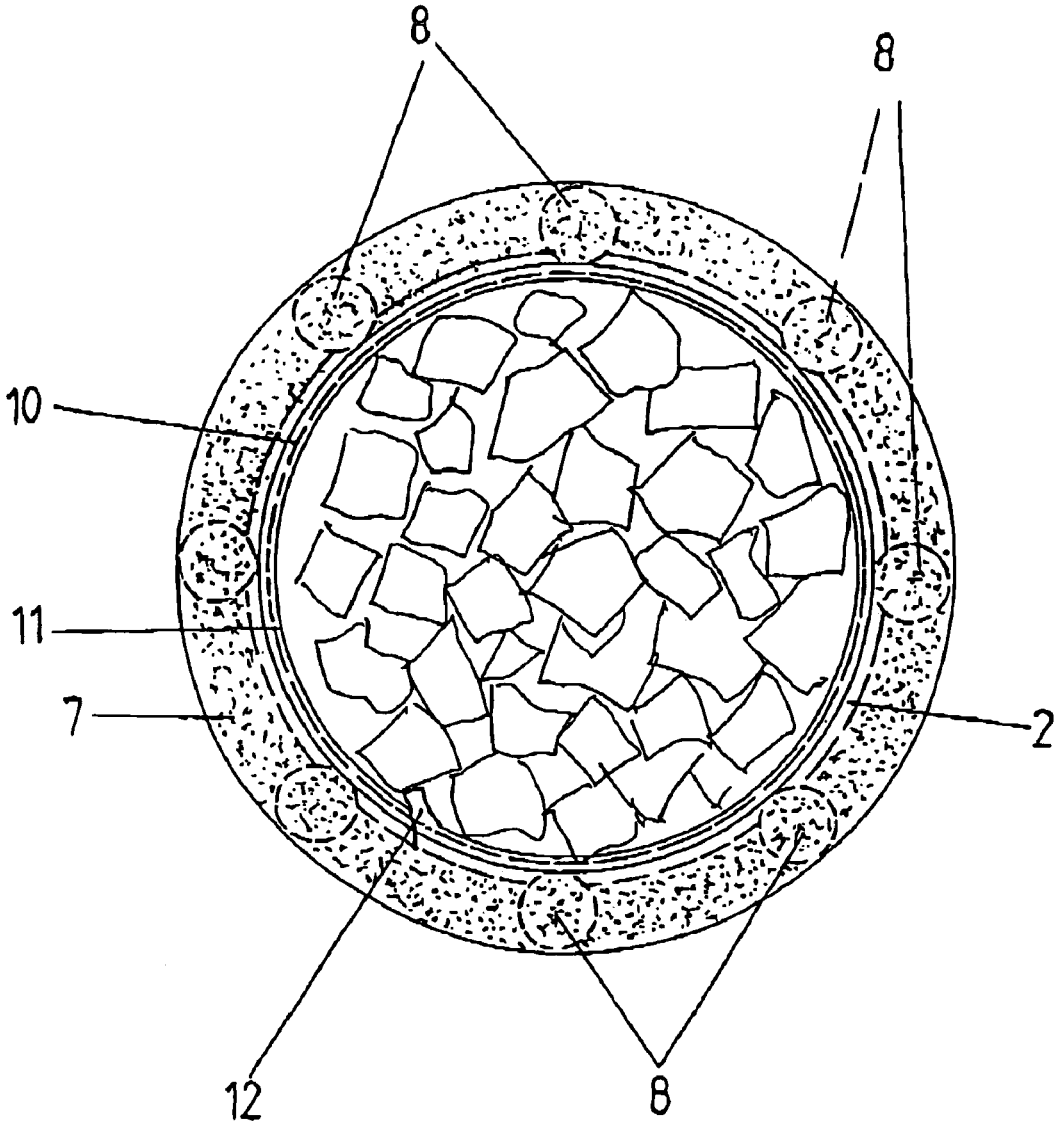
FIG. 2 is a view from below of the drink bottle according to the invention.

The drink bottle according to the invention for a cola drink is comprised as shown in FIG. 1 generally of a bottle body 1 of injection-molded biologically safe plastic having a side wall 2 and a floor 3. A drink-holding interior space 4 is closed by a screw cap 5. The floor 3 is inset somewhat under the center of the body 2 and forms an outer compartment 6. The wall 2 sits on a base ring 7. Tubes 8 in fluid communication with the space 4 and with the hollow base ring 7 extend from the floor 3 parallel to an axis A of the bottle so that a beverage can fill the tubes 8 and the base ring 7. The tubes 8 stiffen the lower part of the wall 2 of the bottle. The base ring 7 defines an opening 9 through which a drinking glass 10 can be slipped into the outer compartment. The drinking glass 10 is filled with ice cubes. The stiffening of the lower region of the bottle wall makes it possible to form it rather thin so that the bottle can be made very transparent in this region. The drinking glass and its contents are therefore highly visible from outside and can be used to carry advertising.

The base ring 7 is provided on its inner edge with a tear-off strip 12 by means of which the drinking glass 10 can be secured in the outer compartment 6 after being filled.

For use of the drinking glass 10, the tear-off strip 12 is pulled off the base ring and the drinking glass 10 is taken out of the outer compartment 6. The glass 10 is provided with an unillustrated cover foil that protects its contents.

The drink bottle and glass are injection molded of plastic.

The invention claimed is:

1. A drink bottle comprising:

a side wall and a floor together forming an interior drink space;

an array of tubes extending away from the floor, defining an downwardly open compartment and a plurality of windows, having upper ends in fluid communication with the drink space at the floor, and having lower ends remote from the floor;

a hollow base ring spaced from the floor, attached to the lower ends, and in fluid communication through the tubes with the drink space; and a container adapted to hold ice, fitted inside the compartment, and removable from the compartment through the base ring, the container being visible from outside through the windows.

2. The drink bottle defined in claim 1 wherein the side wall is centered on an axis, the floor extends across the axis, and the tubes are arrayed symmetrically around the axis.

3. The drink bottle defined in claim 2 wherein the tubes extend generally parallel to the axis.

4. The drink bottle defined in claim 1 wherein the container is a cup complementary to the compartment.

5. The drink bottle defined in claim 4, further comprising a tear-off strip securing the cup in the compartment.

6. The drink bottle defined in claim 5 wherein the tear-off strip is annular.

7. The drink bottle defined in claim 1 wherein the side wall, floor, tubes, and base ring are unitarily formed of plastic.

* * * * *